United States Patent [19]

Calcerano

[11] Patent Number: 4,667,827

[45] Date of Patent: May 26, 1987

[54] PACKAGE CARRIER

[75] Inventor: Victor Calcerano, Carmel, N.Y.

[73] Assignee: Duracell Inc., Bethel, Conn.

[21] Appl. No.: 811,244

[22] Filed: Dec. 19, 1985

[51] Int. Cl.[4] ..... B65D 73/00

[52] U.S. Cl. ..... 206/461; 206/466; 206/478; 206/483; 206/493; 211/59.1; 211/72

[58] Field of Search ..... 206/461–471, 206/477–483, 493, 526, 806; 211/49.1, 50, 72, 57.1, 59.1, 71; 248/300, 301

[56] References Cited

U.S. PATENT DOCUMENTS

| | | | |
|---|---|---|---|
| 1,982,640 | 12/1934 | Clark | 206/487 |
| 3,029,939 | 4/1962 | Feldman | 206/466 |
| 3,040,881 | 6/1962 | McNeill | 206/493 |
| 4,312,449 | 6/1982 | Kinderman | 206/526 |

*Primary Examiner*—William Price
*Assistant Examiner*—Jimmy G. Foster
*Attorney, Agent, or Firm*—Ronald S. Cornell; James B. McVeigh

[57] ABSTRACT

A belt package carrier for blister card packages with a locking strap to prevent accidental disengagement of the blister cards from the belt package carrier during shipment.

5 Claims, 4 Drawing Figures

PACKAGE CARRIER

This invention relates to belt type package carriers and particularly to belt carriers for blister card packages.

Blister card packages are generally designed for display, at retail outlets, of contained merchandise with such display being usually effected by hanging the blister carded goods on racks. In order to readily permit such hanging display the blister cards are apertured at their upper ends with a slot with a circular shaped center. The cards can thus be hung on either extending rod or slat hangers depending upon the type of display rack in the individual retail establishment. A means for shipping of such carded merchandise takes advantage of the apertures or hanger holes in the cards whereby unidirectional and uniformly spaced tab cutouts, in an elongated belt, are individually placed through the hanger holes of each of the blister card packages. The belt thus efficiently holds a number of the blister card packages during shipment such as for example in a wound configuration. In addition, the blister cards may also be displayed for retail sale while hanging from the carrier belt with the belt itself being hung from a display rack. However, since the carrier belt also serves as a merchandise display holder, with the blister card packages being readily removable by consumers, a disadvantage arises during shipment since the cards can also readily slip off the tab hangers of the belt package carrier.

It is an object of the present invention to provide a means whereby blister card packages can be locked onto a belt package carrier during shipment and whereby such locking means are easily removable or do not impede intentional removal of the individual blister card packages to permit sale of the individual goods.

This and other objects, features and advantages of the present invention will become more apparent from the following discussion and drawings in which.

Generally the present invention comprises a package carrier for apertured packages such as blister card packages, having slotted hangar holes. The package carrier comprises a belt type carrier with means for releasably holding a plurality of the apertured packages and wherein said package carrier further comprises means for locking the packages onto the belt during shipment whereby accidental dislodgement of apertured packages from the belt is substantially precluded. In a preferred embodiment the belt carrier has a succession of uniformly distanced and unidirectional tabs cut out therein. Each of said tabs is properly sized to be placed into a slotted hangar hole of a blister card package thereby releasably holding said blister card package. The locking means is either removable or does not substantially impede the intentional removal of the packages from the carrier belt. The locking means preferably comprises an elongated strap of a relatively thin plastic having a width smaller than that of the slotted hanger holes of the blister card packages and a length sufficient to at least span the distance between the end tabs of the belt carrier whereby it can be engaged with all of the blister card packages.

In order to lock the blister card packages into non-removable position on the belt carrier, the locking strap is successively woven through the hanger holes of the blister cards on the side of the belt carrier opposite that where the blister card packages are engaged with the cutout tabs of the belt carrier. The locking strap spans the length of the belt between the first and last tabs whereby all the blister card packages are securely held. Thereafter the belt carrier may be readily handled without the need for position orientation (an upside down belt of the prior art resulted in mass disengagement of the blister card packages from the belt particularly if the carded goods are heavy). After shipment when the goods are ready for display, the locking strap is readily removed by pulling it from engagement with the blister card packages and the goods are accordingly released for individual purchase and removal.

The strap may be made of any material such as leather, cardboard, plastic etc. provided that the strap has sufficient tensile strength to resist tearing by the weight of the blister card packages. Preferably the strap should have a uniform width to facilitate the weaving and the preferred material of the strap is a plastic because of economic considerations. Examples of suitable plastics include medium impact ABS, cellulose acetate, polyester, medium and high density polyethylene, non-oriented polypropylene, balanced polypropylene, PVC and the like.

Figure 1:
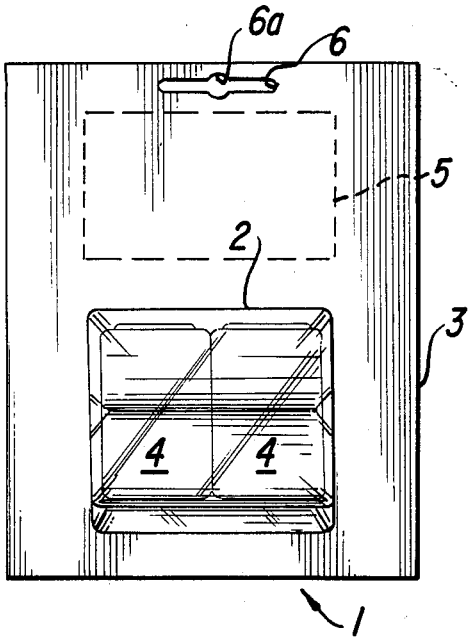
FIG. 1 is a front view of a typical blister card package.
Figure 2:
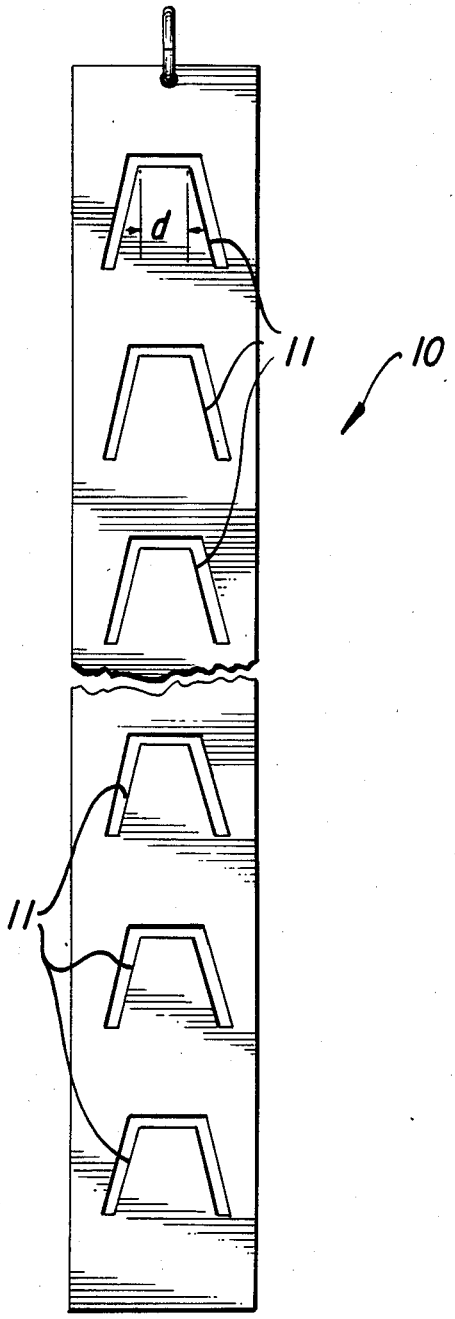
FIG. 2 is a front view of a carrier belt for carrying the blister card packages of FIG. 1.
Figure 3:
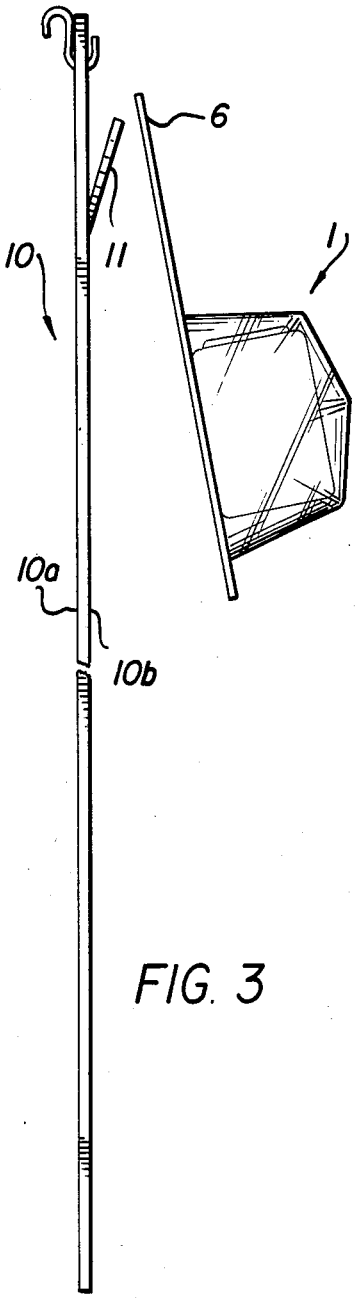
FIG. 3 is a side view showing the blister card package of FIG. 1 being placed onto the carrier belt of FIG. 2.
Figure 4:
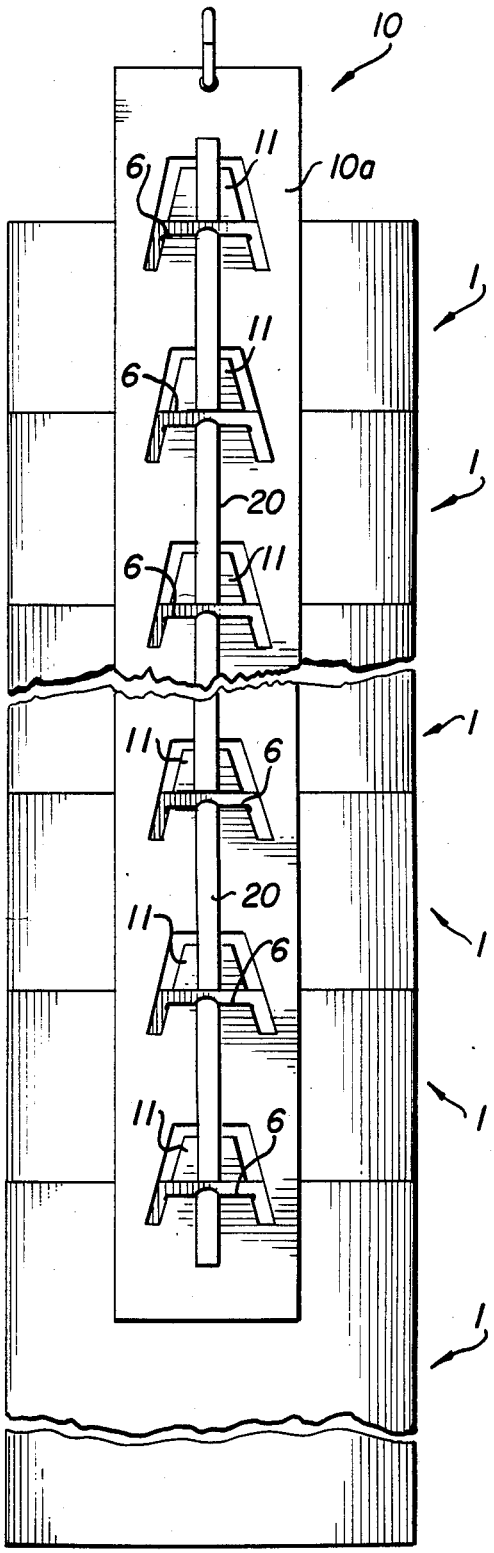
FIG. 4 shows the locking strap of the present invention being placed into position.

With specific reference to the drawings, FIG. 1 depicts a typical blister card package 1 having a plastic blister 2 adhered to a cardboard backing 3 with the goods 4, depicted as batteries, being contained therebetween. The card has a decorative appearance and contains informational material 5 for display to consumers. Hanger hole 6 is shown as a slot with a circular center section **6*a* whereby the blister card package can be hung from racks having either rod or slat extensions. FIG. 2 depicts a belt carrier 10 having cutout tab members 11 having a width d which is less than the width of hanger holes 6 of the blister card packages 1. As shown in FIG. 3, the blister card packages 1 are engaged to the belt carrier by placing the tabs 1 1 through the hanger holes 6. However, with such engagement, the belt carrier 10 must be kept in a position whereby the blister card packages do not slip off the retaining tab members of the belt. Locking strap 20, having a width less than that of the blister card hanger holes, is threaded or woven through the hanger holes 6 of the blister card packages 1 on the side of the belt carrier 10*a* opposite the side 10*b* from which the tab members 11 extend for engagement with the blister card packages 1. As a result of such placement of the locking strap 20, the blister card packages 1 can, at most, only move slightly from engagement with the retaining tab members 11** and are not separable from the belt.

It is understood that the belt carrier with locking strap as depicted in the drawings is a preferred embodiment of the present invention and is illustrative of the present invention. Details contained therein are not to be construed as a limitation on the present invention with structures, dimensions and relative placement of components and the like being possible without departing from the scope of the present invention as defined in the following claims.

What is claimed is:

1. A carrier in combination with a plurality of packages of goods, each package having an aperture, said carrier comprising an elongated belt member; a succession of unidirectional cut out tabs in said belt member with each tab releasably engaging with a one of said apertures of said packages; and a removable locking means simultaneously locking each package to the belt by being successively woven through the apertures of the packages from a side of the belt member opposite to a side on which the packages are engaged with said tabs.

2. The carrier of claim 1 wherein the aperture of each of said packages comprises a slotted hangar hole and wherein the cut out tabs are uniformly spaced and have a width less then the width of the slotted hangar hole.

3. The carrier of claim 2 wherein said locking means comprises an elongated strap having a width smaller than that of the slotted hangar holes of said blister card packages and said strap having a length sufficient to at least span the succession of cut out tabs of said belt member to allow said strap to engage with all of said blister card packages.

4. The carrier of claim 3 wherein said strap is comprised of a material selected from the group consisting of medium impact ABS, cellulose acetate, polyester, medium and high density polyethylene, non-oriented polypropylene, balanced polypropylene, and PVC.

5. A method for locking blister card packages on a carrier belt wherein each of said packages has a slotted hanger hole and said carrier belt comprises a succession of uniformly distanced and unidirectional cut out tabs sized to individually fit within said hangar holes and wherein said packages are releasably engaged with said tabs, said method comprising the step of successively weaving an elongated strap, having a width smaller than that of the slotted hanger holes of the blister card packages and a length sufficient to at least span the succession of cut out tabs of the carrier belt, through the hanger holes of the blister card packages on the side of the carrier belt opposite that where the blister card packages are engaged with the cut out tabs thereof.

* * * * *